313-414 3R
7/21/87 OR 4,682,073

United States Patent [19]

Staub

[11] Patent Number: 4,682,073

[45] Date of Patent: Jul. 21, 1987

[54] ELECTRON OPTICS FOR THE ELECTRON BEAM GENERATING SYSTEM OF A COLOR PICTURE TUBE

[75] Inventor: Norbert Staub, Denkendorf, Fed. Rep. of Germany

[73] Assignee: Alcatel N.V., Amsterdam, Netherlands

[21] Appl. No.: 928,663

[22] Filed: Nov. 6, 1986

Related U.S. Application Data

[63] Continuation of Ser. No. 480,208, Mar. 30, 1983, abandoned.

[30] Foreign Application Priority Data

Apr. 2, 1982 [DE] Fed. Rep. of Germany ..... 321248

[51] Int. Cl.[4] ..... H01J 29/50; H01J 29/56

[52] U.S. Cl. ..... 313/414; 313/431

[58] Field of Search ..... 313/412, 413, 414, 431

[56] References Cited

U.S. PATENT DOCUMENTS

| | | | |
|---|---|---|---|
| 3,448,316 | 6/1969 | Yoshida et al. | 313/414 X |
| 3,771,002 | 11/1973 | Standaart | 313/414 X |
| 3,840,765 | 10/1974 | Takenaka et al. | 313/431 X |
| 3,866,080 | 2/1975 | Barkow | 313/412 |
| 4,142,131 | 2/1979 | Ando et al. | 313/412 X |
| 4,208,610 | 6/1980 | Schwartz | 313/414 |
| 4,225,804 | 9/1980 | Bekaert et al. | 313/413 X |
| 4,275,332 | 6/1981 | Ashizaki et al. | 313/414 |
| 4,346,327 | 8/1982 | Barten | 313/414 X |

*Primary Examiner*—Palmer C. DeMeo
*Attorney, Agent, or Firm*—Peter C. Van Der Sluys

[57] ABSTRACT

By giving special shapes to the shielding parts in the electrodes of an electron beam generating system for the use with color picture tubes, there is obtained an improvement in the electron optics. In this way there is reduced in particular the twist error and a common sharpness or sharp focus point is obtained. At the same time the structure of the electron beam generating system is simplified by reducing the number of component parts. Instead of each time three rings there are inserted each time one or two parts in the "grid 4" and/or the "grid 3". If, in addition thereto, these parts are made from a soft magnetic material, and quite depending on the given share, additional fieldformers (shunts and/or enhancers) can be omitted.

6 Claims, 24 Drawing Figures

ELECTRON OPTICS FOR THE ELECTRON BEAM GENERATING SYSTEM OF A COLOR PICTURE TUBE

This application is a continuation of application Ser. No. 480,208, filed Mar. 30, 1983, and now abandoned.

BACKGROUND OF THE INVENTION

The invention relates to electron optics.

In early types of color television picture tubes, the electron beam generating systems consisted of identical rotationally symmetric electrodes for each electron beam, arranged next to each other. Later on, in the so-called "unitized gun", in the electrode structure of which the individual electrodes are combined, rotationally symmetric electrodes of the same function lying next to each other were replaced by one common electrode for all beams. Such electrodes are asymmetrical, thus representing a different surrounding for the outer and the center beam. It is customary, therefore, to reduce these differences in the grid 3 and the grid 4, which normally form the electrodes of the main focusing lens, by providing one individual ring for each of the three electron beams. The three rings are mounted next to each other in a surrounding electrode part designed as a pot-shaped envelope. Accordingly, rotational symmetry is almost safeguarded inside these rings with respect to the individual electron beams, but the central and outer beams have different surroundings when entering into and emerging from the areas of the rings. On account of this, the shape of the electrostatic focusing field is not only not completely rotationally summetrical, but is not completely rotationally symmetrical to a different extent with respect to each of the central and the outer beams.

It is the object of the invention, with respect to the electrodes forming the electrostatic focusing lens in an electron beam generating system employing combined individual systems, to eliminate differences in the focusing fields for the central and outer beams within the scope of an electron optical improvement of the electrode structure.

SUMMARY OF THE INVENTION

The invention is based on the underlying idea that the unequal effect of the electron optics upon the central and the outer beam can be eliminated more throughly than would be otherwise possible by taking measures for enlarging and amending the symmetry in the electrode structure. It has been found that such improvements in the properties of the focusing lens result whenever the rotational symmetry of the electrostatic field acting within the focusing electrode upon the electron beams, is departed from in a certain way and up to a certain degree. Relative thereto, it was found that stretching the originally rotationally-symmetrical fields by increasing the diameter of the rings provided for in conventional types of focusing electrodes, which are located within the surrounding electrode part of the two electrodes (grid 3 and grid 4) forming the focusing lens, reduces a twist effect. More specifically, this reduction in twist effect is found in cases where the diameter of the rings is increased in the direction of the vertical deflection, so that the rings become elipses with a larger diameter vertically in relation to the plane in which the electron beams extend. The term "twist" refers to the angle between the horizontal line and the lines which the three electron beams inscribe on the screen in the case of a horizontal deflection through the magnetic field of the deflecting yoke.

The reduction of the twist as the result of increasing the diameter of the rings in the direction of the vertical deflection, is explainable as the positional tolerances of the electron beams are then noticed less strongly in the direction of the major axis of the elipse. The differences of the system components likewise have a weaker effect upon the sharpness voltage. The term "sharpness voltage" is used to refer to the voltage to ground potential as existing at the "grid 3", at which the respective beam is focused on the screen. In the case of the combined electrodes in a so-called "unitized gun", the "grid-2" voltage is no longer individually adjustable with respect to each beam, so that high demands also have to be placed on the uniformity of the focusing fields.

These improvements are of especially great significance in the case of thin-neck tubes, because the electron beams are closely adjacent one another and the focusing lens has a comparatively small diameter.

Another way of simplifying the electrode on the "grid-4" side of the focusing lens, which normally carries the field formers (shunts and enhancers) serving to compensate the magnetic deflecting field, and according to an embodiment of the invention, is to form parts of the electrode itself from a soft-magnetic material. This allows the soft-magnetic field formers which are welded to the outside of the electrodes to be omitted either completely or partly. This results in a further simplification in manufacturing the electron beam generating system, because then the electrode with the field formers no longer consists of eight, but only of five and, in the most favorable case, only of three parts.

In an embodiment of the invention, planar shield members are positioned between pairs of apertures formed in a pot-shaped container or housing. The shield members extend in parallel with electron beams that pass through the apertures.

BRIEF DESCRIPTION OF THE DRAWINGS

The invention will now describe with reference to FIGS. 1 to 9 of the accompanying drawings, in which.

DETAILED DESCRIPTION OF THE PREFERRED EMBODIMENTS

Figure 1E:
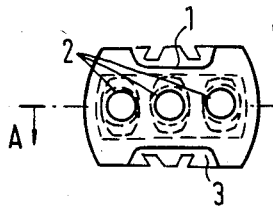
Fig.1e PRIOR ART
FIG. 1*e* shows part of the grid-3 electrode of the conventional system (view V in FIG. 1*a*)
Figure 1D:
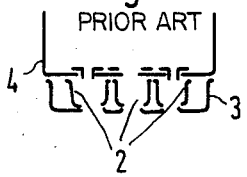
Fig.1d PRIOR ART
FIG. 1*d* is the cross-sectional view taken through the grid-4 electrode of the conventional system as shown in FIG. 1*a* (section taken on line C-D of FIG. 1*b*)
Figure 1A:
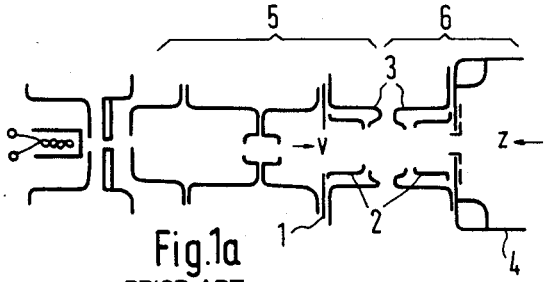
Fig.1a PRIOR ART
FIG. 1*a* is a longitudinal section taken through a conventional type of electron beam generating system.
Figure 1B:
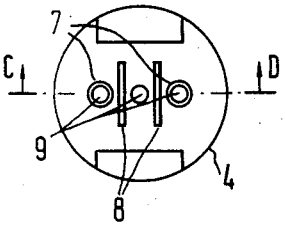
Fig.1b PRIOR ART
FIG. 1*b* is the front view of the conventional type of electron beam generating system (view Z according to FIG. 1*a*)
Figure 1C:
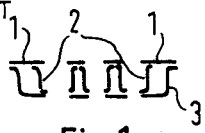
Fig.1c PRIOR ART
FIG. 1*c* is the cross-sectional view taken through the grid-3 electrode of the conventional system as shown in FIG. 1*a* (section taken along line A-B of FIG. 1*e*)

Referring now more particularly to FIGS. 1*a* through 1*e,* there is shown a conventional type of electron beam generating system. The parts indicated by the reference numeral 5 are generally referred to as the "grid 3", and the parts indicated by the reference numeral 6 are generally referred to as the "grid 4". The "grid 4" (6), compared with the "grid 3" (5), has a strongly different electric potential, so that an electrostatic focusing lens is formed between grids 5 and 6. FIG. 1*b,* which is a front view onto the "grid 4" (6) shows field forming means comprised of at least shunts 7 and enhancers 8. The shunts 7 and enhancers 8 effect the magnetic deflecting field of a deflection unit arranged on the neck of the tube and also acts upon the electron beams passing through the three apertures 9.

FIG. 7, likewise shows a prior art electron beam generating system. The three identical parts 2 are in this case mounted to the so-called convergence pot 4 shown in FIGS. 1*a* and 1*c.*

Figure 2A:
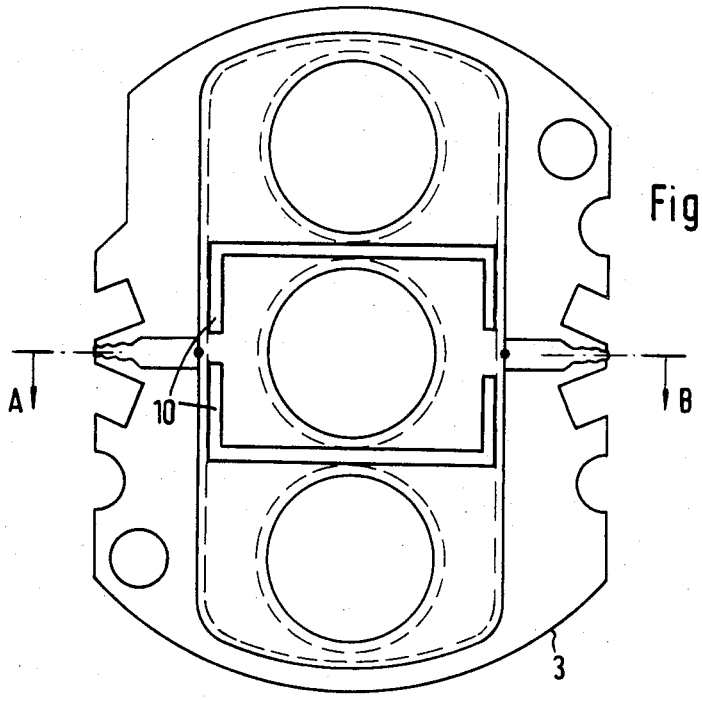
FIG. 2*a* is the front view of the example of embodiment of the invention (parts in a pot-shaped envelope or container)
Figure 2B:
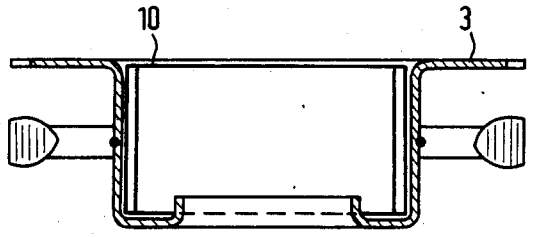
FIG. 2*b* is a section taken on line A-B of FIG. 2*a;*
Figure 5A:
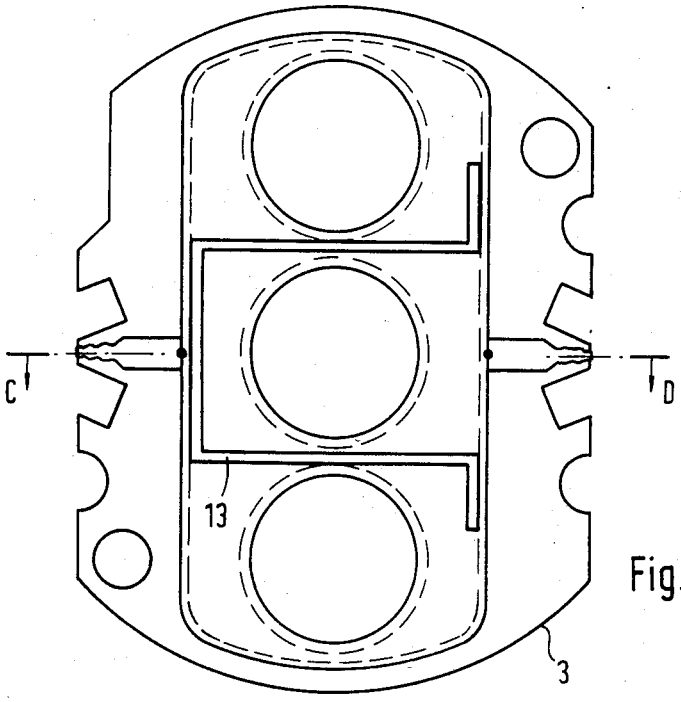
FIG. 5*a* is the front view of the example of embodiment of the invention.
Figure 5B:
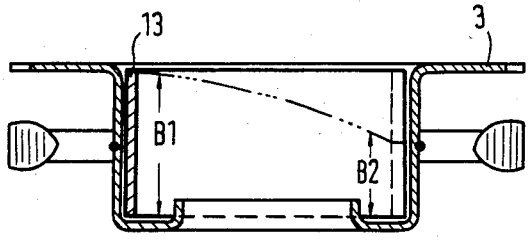
FIG. 5*b* is a section taken on line C-D of FIG. 5*a;*

In FIG. 2*a,* two identical parts 10 are shown to be mounted inside the pot-shaped envelope or container 3. As shown in FIG. 2*b,* the height of these parts 10 is chosen to correspond to the depth of the pot impressed into part 3. This height of the parts, as is shown in FIGS. 5*b* and 6*b,* may also be variable.

Figure 3A:
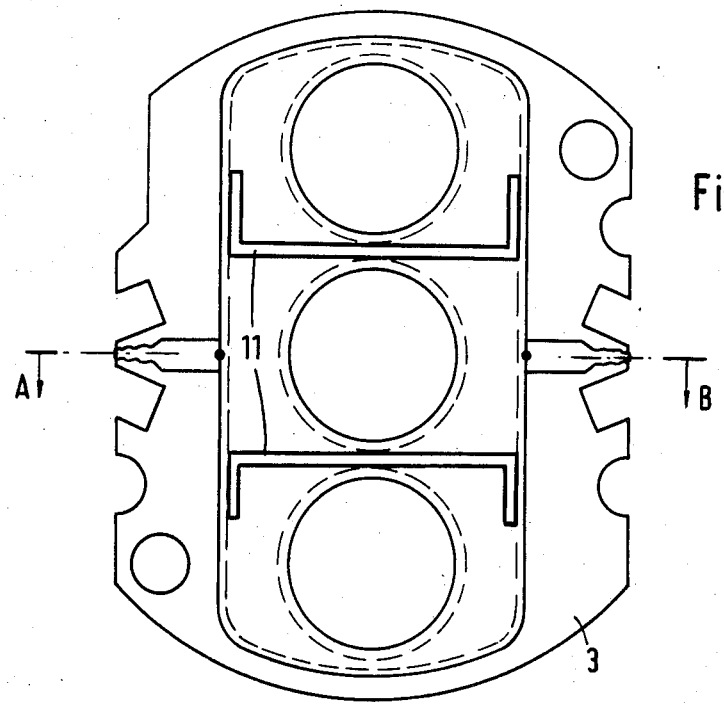
FIG. 3*a* is the front view of the example of embodiment of the invention.
Figure 3B:
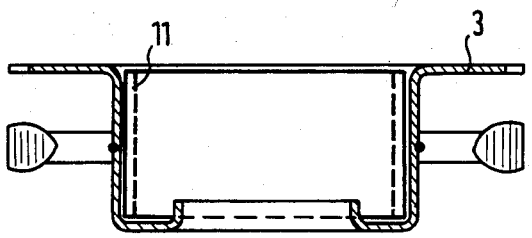
FIG. 3*b* is a section taken on line A-B of FIG. 3*a;*

FIG. 3*a* likewise shows two identical parts 11 which, however, are mounted with their flanges on the side of the outer beams.

Figure 4A:
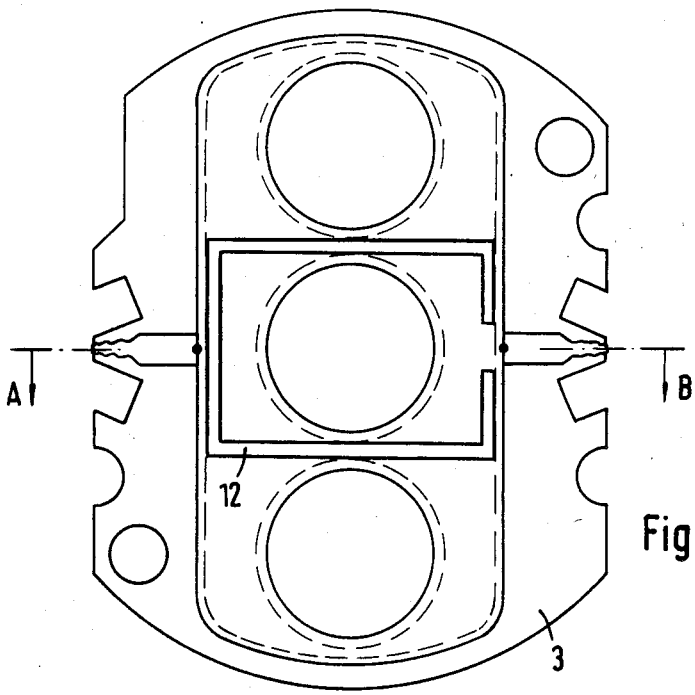
FIG. 4*a* is the front view of the example of embodiment of the invention.
Figure 6A:
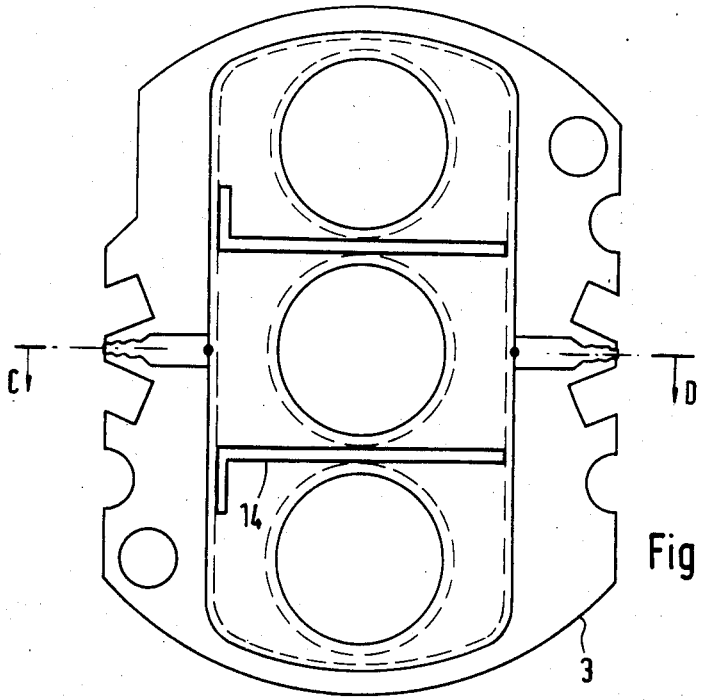
FIG. 6*a* is the front view of the example of embodiment of the invention.
Figure 6B:
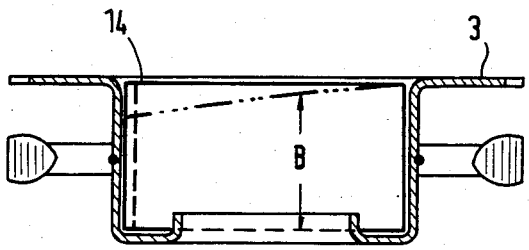
FIG. 6*b* is a section taken on line C-D of FIG. 6*a;*

FIGS. 4*a,* 4*b* and 5*a,* 5*b* show examples of two embodiments of the present invention each employing only one part 12 or 13 respectively, while FIGS. 6*a,* 6*b* still show an example employing two identical, but asymmetrical parts 14. In all of the examples as shown in FIGS. 2 through 6, the parts 10, 11, 12, 13 and 14 are mounted inside the pot-shaped container 3. An equally suitable way of mounting the parts 10 and 14 is to fix them on a board 1 (see also FIG. 1*a*) which is then attached to the pot-shaped container 3. Further constructional varieties are possible bearing in mind that it is essential that the one or more parts inside the pot-shaped container 3, with their surfaces extending parallel in relation to the wall surfaces of the pot, are arranged in such a way that the three electron beams are shielded with respect to one another inside the pot. The exact dimensioning and the shaping of the parts is carried out by taking into consideration the respective trial and computing results.

Figure 7A:
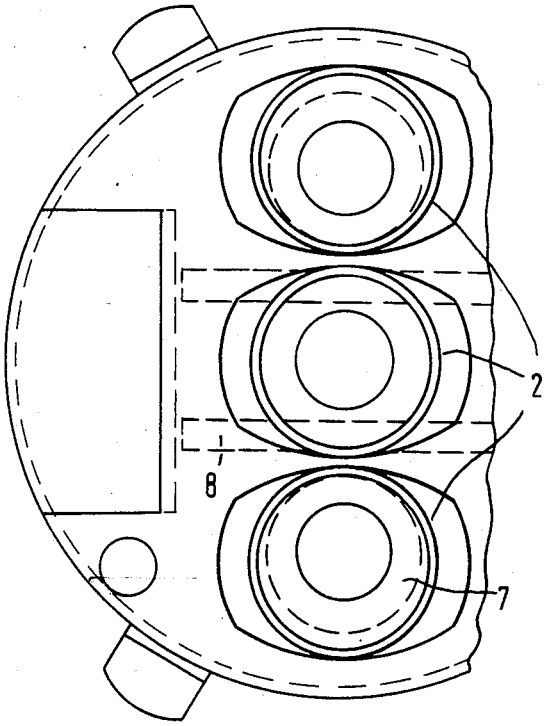
Fig.7a PRIOR ART
FIG. 7*a* is the front view (view x) of the grid-4 electrode of a conventional type of electron beam generating system.
Figure 7B:
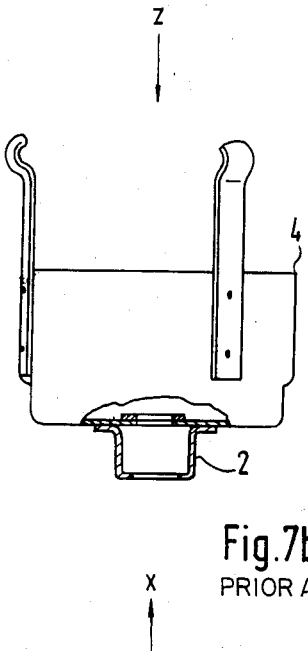
Fig.7b PRIOR ART
FIG. 7*b* is the side view of the grid-4 electrode as shown in FIG. 7*a;*
Figure 7C:
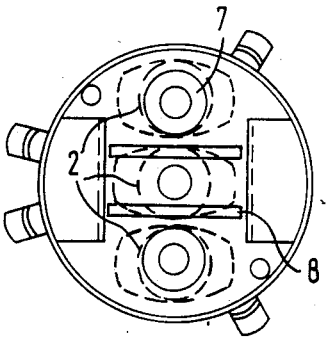
Fig.7c PRIOR ART
FIG. 7*c* is the view z of the grid-4 electrode as shown in FIG. 7*b;*

Referring now more particularly to FIGS. 7*a–c,* there is shown a prior art configuration of the "grid 4" (6). FIG. 7*a* is the front view in the direction x, and FIG. 7*c* shows the view as seen when looked at from the direction z. The partly sectional view of FIG. 7*b* shows how the parts 2 are arranged on the outside bottom of the pot over the openings 9 permitting the passage of the electron beams. The surrounding part, i.e. the pot-shaped envelope or container 3 (shown in FIGS. 1*a,* 1*e,* 2*a,* 2*b,* 3*a,* 3*b,* 4*a,* 4*b,* 5*a,* 5*b,* 6*a* and 6*b*), which is provided in the conventional as well as in the present invention, is not shown in FIG. 7 for the sake of clarity. In the "grid 4" (6), the conventional three identical parts 2 are attached to the so-called convergence pot. Also attached to the convergence pot, but on the other side of the bottom part of the pot, are the field formers which themselves are formed from a magnetic material. The field formers include the two rings or shunts 7 around the passage openings for the outer beams, as well as the strips or enhancers 8 arranged on both sides of the passage opening for the central beam.

According to a further embodiment of the invention, not only are the three parts 2 replaced by one or two parts 10, 11, 12, 13 and 14 as noted above, but these parts are also designed in such a way as to perform the function of the field formers as well. Specifically, parts 10, 11, 12 and 13 function to equally distribute the effect of the deflecting field of the deflection unit to all three beams.

Figure 8A:
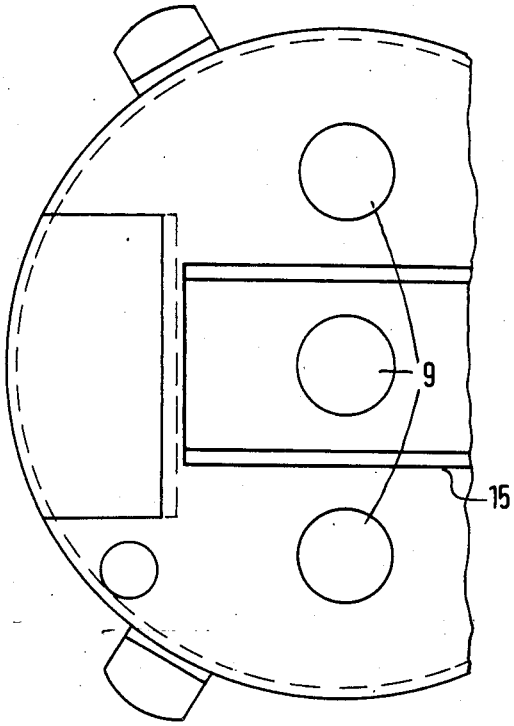
FIG. 8*a* is the front view of the example of embodiment F of the invention in the way as represented in FIG. 7*a;*
Figure 8B:
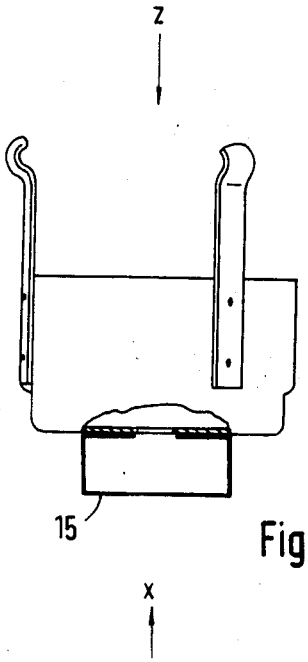
FIG. 8*b* is the side view of the example of embodiment as shown in FIG. 8*a;*
Figure 8C:
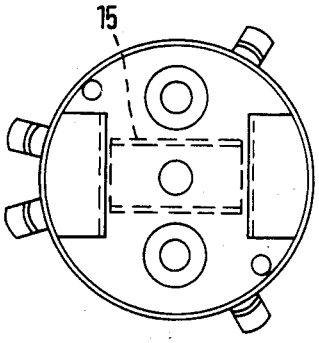
FIG. 8*c* is the view z of the example of embodiment as shown in FIG. 8*b;*
Figure 9A:
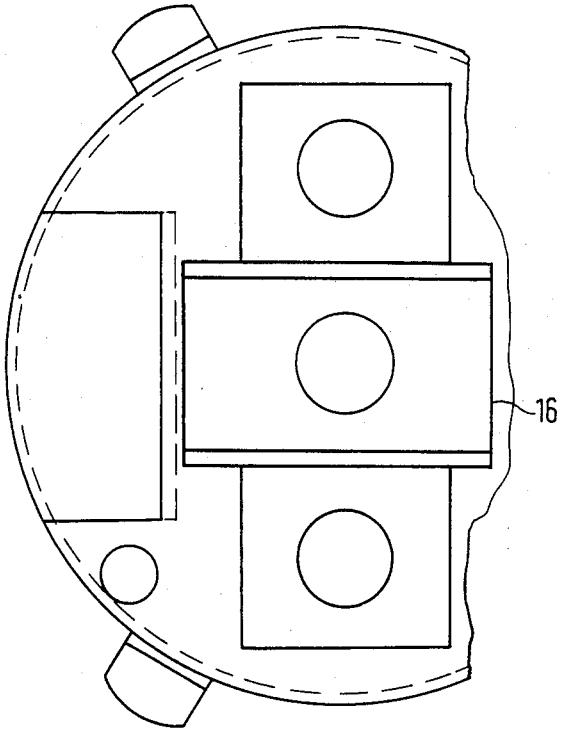
FIG. 9 is the front view of the example of embodiment of the invention, in the way as represented in FIG. 7*a;*
FIG. 9*b* is the view z of the example of embodiment as shown in FIG. 9*b.*
Figure 9B:
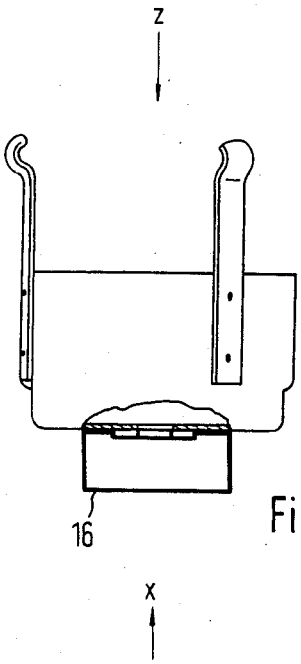
Figure 9C:
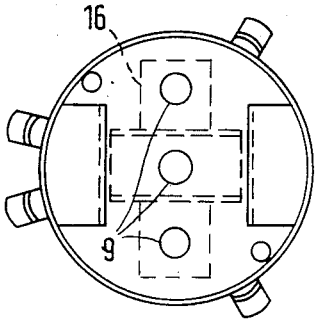

Referring now more particularly to FIGS. 8 and 9, there is shown two examples of embodiments relating thereto. The parts 15, shown in FIGS. 8*a–c,* and 16, shown in FIGS. 9*a–c,* are made, at least partly, from a magnetic material. These parts 15, 16, in order to be capable of performing the field-forming task as well as parts 10 to 14, are provided with flange-like additional surfaces by which they are completed in such a way as to be capable of performing the field-forming function. Here, too, both the dimensions and the shape are determined in dependence upon the given characteristics of the electrode structure, based on the respective trial and computing results.

By employing the shielding plates 10 to 14 instead of the rotational-symmetrical rings, additional degrees of freedom are obtained for designing the electric fields in the surrounding parts 3, which are codeterminative of the electrostatic focusing lens 5/6. Some possible embodiments are shown in FIGS. 2 through 6. Further possibilities of design will result when the surrounding part 3 is included in the optimization. If, in accordance with a further embodiment, e.g., the parts 15 and 16 as shown in FIGS. 8 and 9 are made from a ferromagnetic material, it will be possible for them to still perform the function of the field formers 7 and 8.

Figure 4B:
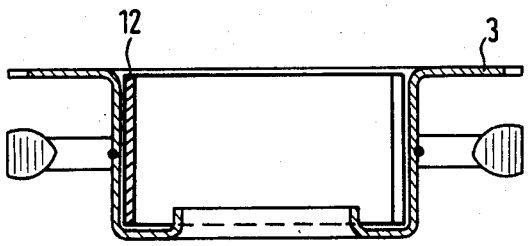
FIG. 4*b* is a section taken on line A-B of FIG. 4*a;*

The advantages resulting from the invention are as follows:

1. The mechanical structure of the electrodes forming the focusing lens is simplified. For example, four parts can be omitted when in the top part of the "grid 3" (5) and in the "grid 4" (6), and as shown in FIGS. 4 or 5, there is each time only used one U-shaped part instead of each time the three rings 2.

2. The twist error is restricted. If, owing to assembling tolerances, the electrode apertures are staggered or the electrodes are twisted, the tolerating sensitivity to twisting is reduced by the enlarged spacing of the electron beams from the surrounding part 3.

3. The common sharpness voltage area becomes larger. It has proved in production that in a test pattern with an evenly spaced ruling in one color, it is very difficult to obtain a common sharpness or sharp focus point of both the horizontal and the vertical lines. Such a common sharpness point, however, was possible to be achieved by employing the parts 10 through 16 and, consequently, by a non-rotation-symmetrical field superimposed upon the focusing lens.

4. By arranging the shield plates consisting either completely or partly of a ferromagnetic material, the hitherto employed field formers (shunts and enhancers) for serving as field-forming means, may be omitted.

I claim:

1. In an electron gun assembly usable in a multiple electron beam television picture tube wherein at least one of grid 3 or grid 4 includes a pot-shaped housing disposed in the electron beam generating system of said picture tube, said pot-shaped housing having a plurality of separate, spaced apart, apertures formed therein through which the electron beams pass, each of said apertures having a central axis, the axes of said apertures lying in a common plane, an improvement wherein field forming devices utilized in said at least one of grid 3 or grid 4 consist of:

a first planar, rectangular, shielding member of magnetic material and means for affixing said member to the housing between a first selected pair of apertures through which pass first and second adjacent electron beams with said shielding member extending perpendicular to said plane;

a second planar, rectangular, shielding member of magnetic material spaced apart from said planar shielding member and affixed to the housing between a second selected pair of apertures through which pass second and third adjacent electron beams with said second shielding member extending perpendicular to said plane whereby said first and second shielding members are parallel to each other.

2. An electron gun assembly as defined in claim 1 wherein said first and second planar shielding members are formed from a selected soft-magnetic material.

3. An electron gun assembly as defined in claim 1 wherein said affixing means includes a first planar mounting element attached to an end of said shielding member, perpendicular thereto, and affixed to the housing.

4. An electron gun assembly as defined in claim 3 wherein said affixing means includes a second planar mounting element attached to a second end of said shielding member, perpendicular thereto, and affixed to the housing.

5. An electron gun assembly as defined in claim 1 wherein said spaced apart first and second shielding members are joined by a planar element essentially perpendicular thereto.

6. An electron gun assembly as defined in claim 1 wherein first and second shielding members have a length dimension that corresponds substantially to the depth of the housing.

* * * * *